United States Patent [19]

Nagata et al.

[11] Patent Number: 5,017,852

[45] Date of Patent: May 21, 1991

[54] ELECTRIC CONTROL APPARATUS FOR DISHWASHING MACHINE

[75] Inventors: Osamu Nagata, Toyoake; Tokihiro Kuwahara, Kariya; Yukichi Suzawa, Nagoya; Hiroaki Kamino, Toyoake; Tomio Suyama, Toyoake; Tomoyoshi Konno, Toyoake, all of Japan

[73] Assignee: Hoshizaki Denki Kabushiki Kaisha, Toyoake, Japan

[21] Appl. No.: 469,910

[22] Filed: Jan. 25, 1990

[30] Foreign Application Priority Data

Jan. 25, 1989 [JP] Japan ..... 1-15688
Feb. 1, 1989 [JP] Japan ..... 1-11035

[51] Int. Cl.[5] ..... A47L 15/00

[52] U.S. Cl. ..... 318/727; 134/57 D; 134/58 D; 134/25.2

[58] Field of Search ..... 318/567, 727, 767, 779, 318/786; 68/12 R, 12 FA, 23.5, 23.6, 23.7; 34/43, 44, 45, 52, 53, 55, 56; 134/18, 25.1, 25.2, 58 R, 58 D, 57 R, 57 D, 56 R, 56 D; 364/140, 141, 143

[56] References Cited

U.S. PATENT DOCUMENTS 4,004,600 1/1977 Corn et al. ..... 134/57 D
4,068,179 1/1978 Sample et al. ..... 134/57 D X
4,097,307 6/1978 Geiger ..... 134/57 D X
4,182,351 1/1980 Deaton et al. ..... 134/58 D
4,481,786 11/1984 Bashark ..... 318/438 X

FOREIGN PATENT DOCUMENTS 2428991 1/1976 Fed. Rep. of Germany ... 134/58 D
2720958 11/1978 Fed. Rep. of Germany ... 134/58 D
2609192 7/1988 France ..... 134/58 D

*Primary Examiner*—Bentsu Ro
*Attorney, Agent, or Firm*—Armstrong, Nikaido, Marmelstein, Kubovcik & Murray

[57] ABSTRACT

An electric control apparatus for a dishwashing machine having a washing chamber, a wash pump arranged to be driven by an electric motor for pumping up wash water from a wash water storage tank in the washing chamber, and a revolving wash arm arranged within the washing chamber to be supplied with the wash water from the pump for directing jet streams of the wash water to a rack of tableware placed in the washing chamber. The electric control apparatus includes a microcomputer programmed to memorize control data defined in relation to the lapse of washing time such that the supply amount of wash water to the wash arm is intermittently increased and decreased after gradually increased up to a predetermined amount at an initial stage of washing operation and to control the rotational speed of the electric motor in accordance with the lapse of washing time based on the control data.

6 Claims, 4 Drawing Sheets

ELECTRIC CONTROL APPARATUS FOR DISHWASHING MACHINE

BACKGROUND OF THE INVENTION

1. Field of the Invention

The present invention relates to a dishwashing machine, and more particularly to an electric control apparatus for controlling the washing operation of the dishwashing machine in accordance with the tableware to be cleaned.

2. Description of the Prior Art

Disclosed in Japanese Patent Early Publication No. 50-63768 is a dishwashing machine which includes revolving wash arms arranged within a washing chamber to be supplied with hot wash water from a hot water storage tank. The revolving wash arms rotate continuously to direct powerful jet streams of wash and rinse water to a rack of soiled tableware such as dishware, glassware and the like placed in the washing chamber. In the dishwashing machine, however, the supply amount of wash water to the wash arms is suddenly increased up to a predetermined amount at the start of washing operation. This results in a sudden increase of the pressure of jet streams of wash water, causing noises in the washing chamber and impacts on support mechanisms of the wash arms. Since the supply amount of wash water to the wash arms is maintained at the predetermined amount during washing operation, it is difficult to remove food soils adhered to the racked tableware. In case the racked dishware and glassware are different in weight, size and soiled conditions, the light glassware will be tumbled or blown off by the pressure of jet streams of hot wash water directed thereto. To prevent breakage of the light glassware, the pressure and amount of the jet streams should be controlled to be lower and in a small amount. For this reason, a long time is consumed in washing and rinsing of heavily soiled dishware, resulting in a decrease of washing efficiency of the machine.

SUMMARY OF THE INVENTION

It is, therefore, a primary object of the present invention to provide an electric control apparatus for the dishwashing machine capable of gradually increasing the supply amount of wash water to the wash arms at the start of washing operation.

A secondary object of the present invention is to provide an electric control apparatus for the dishwashing machine capable of intermittently increasing and decreasing the supply amount of wash water to the wash arms during washing opertion.

A tertiary object of the present invention is to provide an electric control apparatus for the dishwashing machine capable of controlling the pressure and amount of jet streams of wash and rinse water in accordance with the kind of soiled tableware such as dishware, glassware and the like.

According to the present invention, the primary and secondary objects are attained by providing an electric control apparatus for a dishwashing machine having a washing chamber, a wash pump arranged to be driven by an electric motor for pumping up wash water from a wash water storage tank in the washing chamber, and a revolving wash arm arranged within the washing chamber to be supplied with the wash water from the pump for directing jet streams of the wash water to a rack of tableware placed in the washing chamber, which control apparatus comprises memory means for memorizing control data defined in relation to the lapse of washing time such that the supply amount of wash water to the wash arm is intermittently increased and decreased after gradually increased up to a predetermined amount at an initial stage of washing operation, and means for controlling the rotational speed of the electric motor in accordance with the lapse of washing time based on the control data.

The tertiary object of the present invention is attained by providing an electric control apparatus for the dishwashing machine described above, which comprises means for producing a first operation signal in a first condition where heavy tableware is placed in the rack in the washing chamber and for producing a second operation signal in a second condition where light tableware is placed in the rack in the washing chamber, memory means for memorizing first control data defined in relation to the lapse of washing time such that the supply amount of wash water to the wash arm is controlled to be suitable for washing the heavy tableware in the first condition and for memorizing second control data defined in relation to the lapse of washing time such that the supply amount of wash water to the wash arm is controlled to be suitable for washing the light tableware in the second condition, means for selecting the first control data in response to the first operation signal and for selecting the second control data in response to the second operation signal, and means for controlling the rotational speed of the electric motor in accordance with the lapse of washing time based on the selected control data.

BRIEF DESCRIPTION OF THE DRAWINGS

Additional objects, features and advantages of the present invention will be more readily appreciated from the following detailed description of a preferred embodiment thereof when taken together with the accompanying drawings, in which.

DESCRIPTION OF THE PREFERRED EMBODIMENT

Figure 1:
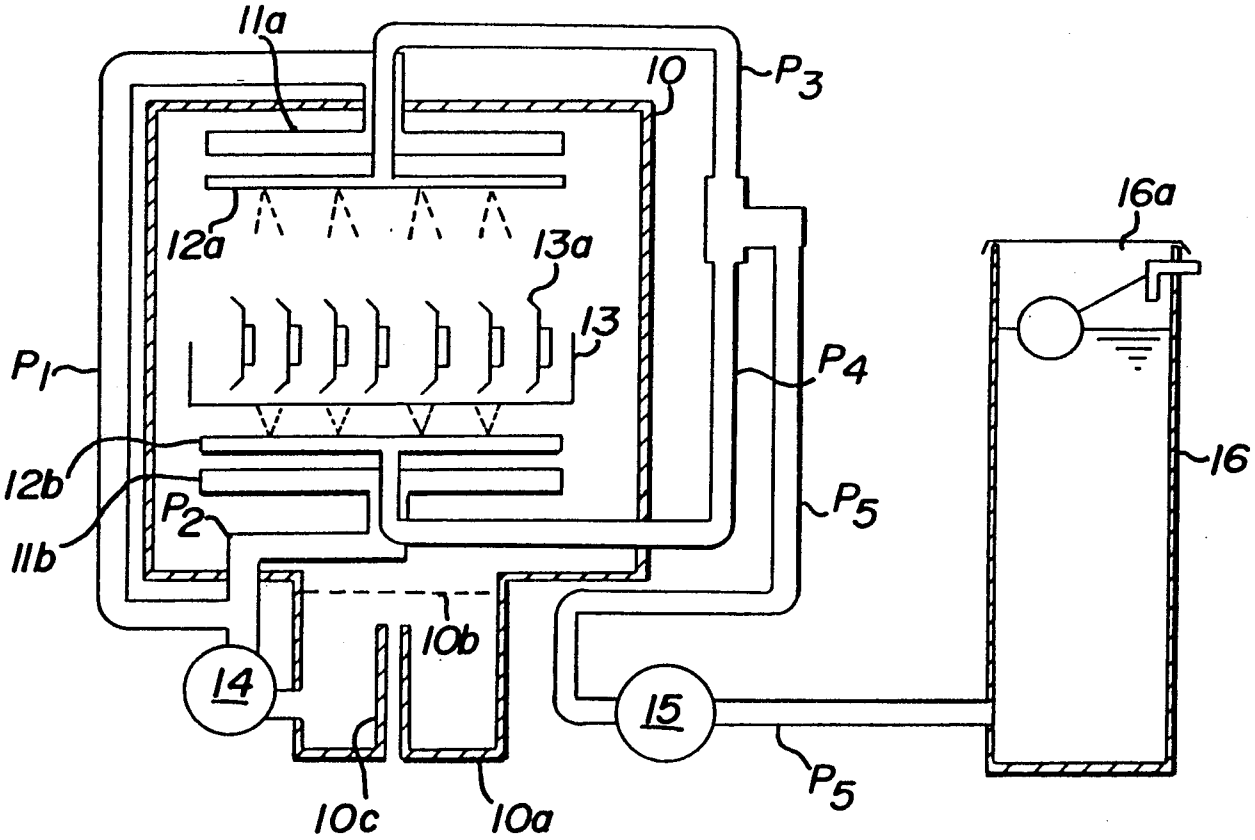
FIG. 1 is a schematic sectional view of a dishwashing machine.

Referring now to the drawings, FIG. 1 schematically illustrates a dishwashing machine of the rack door-type which includes a box-type housing 10 forming therein a washing chamber, upper and lower revolving wash arms 11*a*, 11*b* arranged within the housing 10 and connected respectively to pipes $P_1$, $P_2$, and upper and lower revolving rinse arms 12*a*, 12*b* arranged inside the wash arms 11*a*, 11*b* and connected respectively to pipes $P_3$, $P_4$. Disposed between the rinse arms 12*a*, 12*b* is a rack 13 which receives thereon tableware 13*a* to be washed. When supplied with hot wash water through pipes $P_1$, $P_2$, the wash arms 11*a*, 11*b* rotate to direct powerful jet streams of the hot wash water to the rack 13 of tableware. When supplied with fresh hot rinse water through pipes $P_3$, $P_4$, the rinse arms 12*a*, 12*b* rotate to direct jet streams of the hot rinse water to the rack 13 to clean the tableware. During such washing and rinsing operation, the rotational speed of the wash and rinse arms will change in proportion to the supply amount of hot wash and rinse water thereto, and also the spray pattern and angle of wash and rinse water will change in proportion to the pressure of the jet streams.

Figure 2:
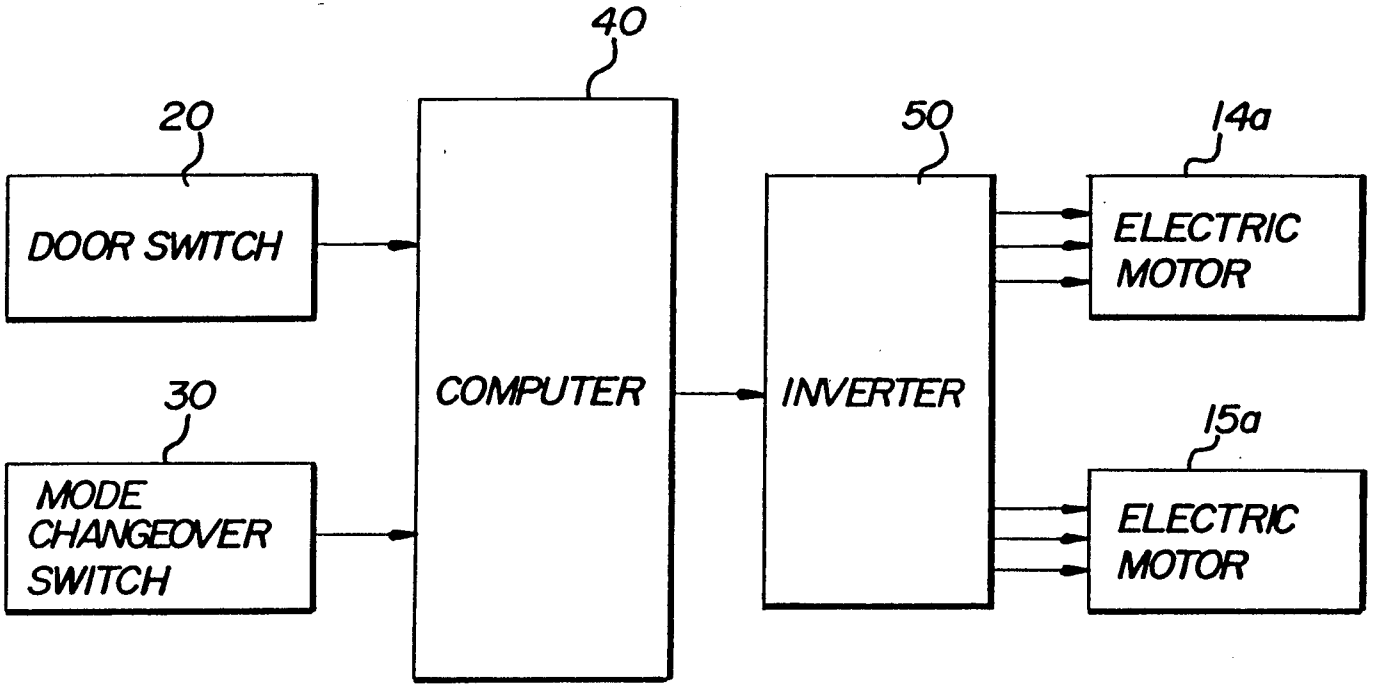
FIG. 2 is a block diagram of an electric control apparatus for the washing machine in accordance with the present invention.

The pipes $P_1$, $P_2$ are connected to a wash pump 14 which is mounted to a wash tank 10*a* with an overflow pipe 10*c* in such a manner as to be driven by an electric motor 14*a* shown in FIG. 2. In operation, the wash pump 14 acts to pump up the hot wash water from tank 10*a* and supply it to the revolving wash arms 11*a*, 11*b* through pipes $P_1$, $P_2$. The wash water is recirculated into the tank 10*a* through a strainer 10*b*. A rinse pump 15 is connected at its inlet to a fresh hot water storage tank 16 through an upstream portion of a pipe $P_5$ and at its outlet to the pipes $P_3$, $P_4$ through a downstream portion of pipe $P_5$. A ball tap 16*a* is provided within the tank 16 to maintain the level of stored fresh hot rinse water at a predetermined level. The rinse pump 15 is driven by an electric motor 15*a* shown in FIG. 2 to pump out the fresh hot rinse water from tank 16 and supply it to the revolving rinse arms 12*a*, 12*b* through pipes $P_5$, $P_3$ and $P_4$. In this embodiment, the electric motor 14*a* is in the form of a three-phase squirrel-cage induction motor (200V, 1.5KW), and the electric motor 15*a* is in the form of a three-phase squirrel-cage induction motor (200V, 200W).

As shown in FIG. 2, an electric control apparatus for the dishwashing machine includes a door switch 20 and a mode changeover switch 30. The door switch 20 is arranged to be closed when a door of the washing chamber has been closed. As will be described later, the door switch 20 is adapted as a mode selection switch for operating the dishwashing machine in a standard operation mode. The mode changeover switch 30 is provided on an appropriate portion of the washing chamber door to be manually operated in a condition where light tableware such as glassware is placed in the rack 13 to be washed.

Figure 3:
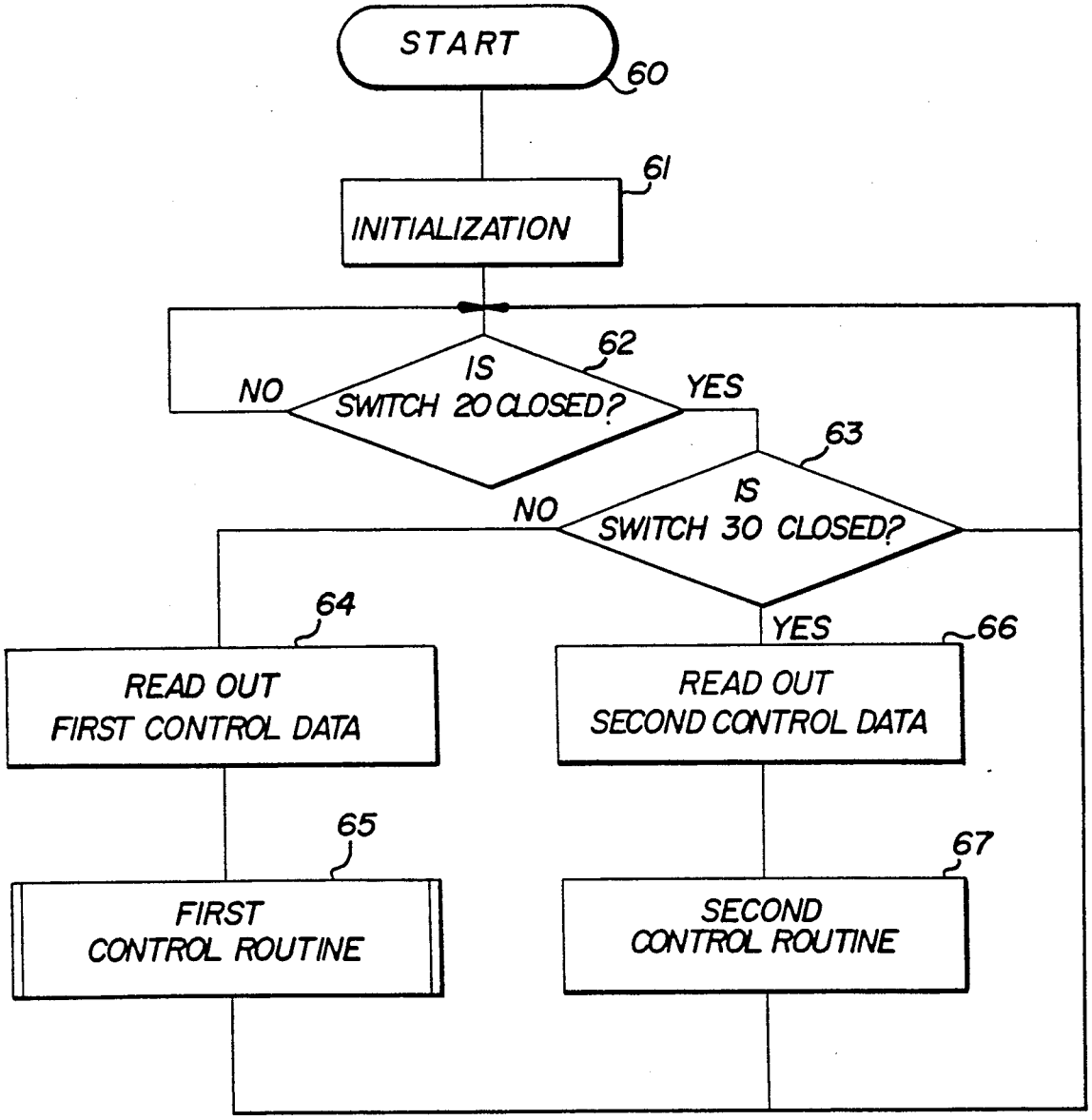
FIG. 3 is a flow chart of a control program executed by a microcomputer shown in FIG. 2.
Figure 4:
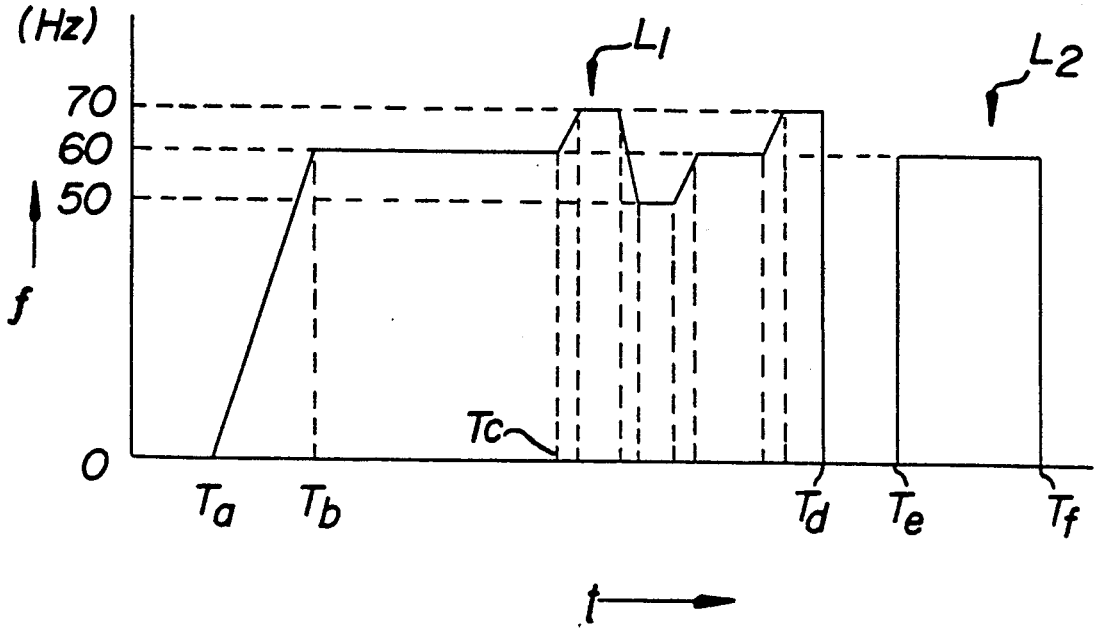
FIG. 4 is a graph showing first control data memorized in the computer.
Figure 5:
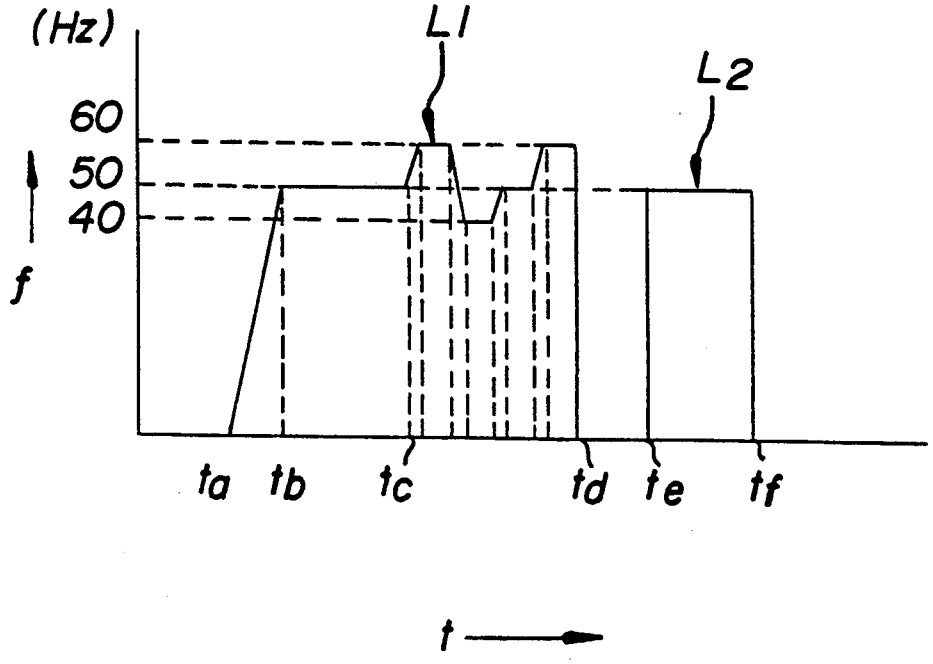
FIG. 5 is a graph showing second control data memorized in the computer.

The electric control apparatus includes a microcomputer 40 which cooperates with the door switch 20 and mode changeover switch 30 to execute a control program shown by a flow chart in FIG. 3. During execution of the control program, the computer 40 carries out calculation necessary for control of an inverter 50 connected to the electric motors 14*a* and 15*a*. The computer 40 has a read-only memory or ROM which is arranged to memorize the control program and to memorize first and second control data as shown in FIGS. 4 and 5 respectively. The first control datum of FIG. 4 includes first and second curves $L_1$ and $L_2$ respectively representing a relationship between the lapse of time t and output frequency f of inverter 50 for washing and rinsing operation in a condition where heavy dishware is placed in the rack 13. Similarly, the second control datum of FIG. 5 includes first and second curves $\mathbf{1}_1$ and $\mathbf{1}_2$ respectively representing a relationship between the lapse of time t and output frequency of inverter 50 for washing and rinsing operation in a condition where light glassware is placed in the rack 13.

Described below is the reason why the control data have been determined as shown in FIGS. 4 and 5. In general, soiled tableware to be washed may be divided into heavy and light items. The heavy items such as dishes are heavily soiled, while the light items such as cups, glasses, saucers and the like are lightly soiled. During washing and rinsing operations, the heavy items are stably held in place in the rack 13 even when the pressure of jet streams has been increased. Meanwhile, the light items will be tumbled or blown off by the pressure of jet streams if it is increased during washing and rinsing operation. Even if the pressure of jet streams is decreased to prevent breakage of the light items, the effectiveness in washing and rinsing of the lightly soiled items will be properly maintained. From such a point of view, the first and second curves $L_1$, $L_2$ of FIG. 4 are defined to be suitable for washing and rinsing of the heavy items, while the first and second curves $\mathbf{1}_1$, $\mathbf{1}_2$ of FIG. 5 are defined to be suitable for washing and rinsing of the light items. In this case, the output frequency f related to the curves $L_1$, $L_2$ is defined to be higher than the output frequency f related to the curves $\mathbf{1}_1$, $\mathbf{1}_2$ as a whole by 10 Hz. The output frequency f is proportional to each rotational speed of electric motors 14*a*, 15*a*, namely each supply amount of hot wash and rinse water to the wash and rinse arms.

Assuming that the time of washing lapses from Ta to Tb or ta to tb immediately after start of the washing operation, the output frequency f related to the curve $L_1$ or $\mathbf{1}_1$ is determined to increase proportionally to the lapse of time t. This is effective to protect the wash arms 11*a*, 11*b* from impacts caused by sudden increase of the amount of wash water supplied thereto. In this embodiment, the lapse of time t from Ta to Tb or ta to tb is defined to be 2 seconds. In the lapse of time t from Tb to Tc or tb to tc, the frquency f related to the curve $L_1$ or $\mathbf{1}_1$ is determined to be maintained at a predetermined value (60 Hz or 50 Hz). This is effective to soften food soils on the tableware by soaking. In the lapse of time t from Tc to Td or tc to td, the frequency f related to the curve $L_1$ or $\mathbf{1}_1$ is determined to be intermittently increased and decreased in a range between 70 and 50 Hz or 60 and 40 Hz. This is effective to rapidly remove the softened food soils from the tableware. In this embodiment, the lapse of time t from Ta to Td is defined to be 32 seconds, while the lapse of time t from ta to td is defined to be 27 seconds. In the lapse of time t from Te to Tf or te to tf, the frequency f is determined to be 60 Hz for 5 minutes or 50 Hz for 7 minutes.

When applied with the power from a commercial power source, the inverter 50 is activated to selectively produce first and second output voltages with three phase under control of the computer 40 as will be described later. In this instance, the first and second output voltages from inverter 50 are each applied to the motors 14*a* and 15*a* to rotate them at a speed proportional to the output frequency f respectively defined by the first and second control data.

1) When relatively heavy dishes have been placed in the rack 13 to be cleaned, the dishwashing machine is operated under control of the computer 40 as follows.

At step 60 shown in FIG. 3, the computer 40 is conditioned to initiate execution of the control program and is initialized at step 61. At the following step 62, the computer 40 determines a "No" answer if the washing chamber door is still opened. When the washing chamber door is closed, the computer 40 determines a "Yes" answer at step 62 in response to a first operation applied thereto from the door switch 20. Subsequently, the computer 40 determines a "No" answer at step 63 and causes the program to proceed to step 64 where the computer reads out the first control data from its read-only memory. When the program proceeds to step 65 for a first control routine of the inverter 50, the computer 40 produces an output signal with output frequency f defined by the first curve $L_1$ of the first control data in accordance with the lapse of time t. When applied with the output signal from computer 40, the inverter 50 applies a three-phase alternating electric current power to the electric motor 14*a* to control the rotational speed of motor 14a in accordance with the output frequency f defined by the first curve $L_1$. Under such control of the electric motor 14*a*, the wash pump 14 is driven to pump up the hot wash water from tank 10*a* and supply it to the wash arms 11*a*, 11*b* through pipes $P_1$, $P_2$, and in turn, the wash arms 11*a*, 11*b* rotate to direct powerful jet streams of the wash water to the racked dishes. During such washing operation, the supply amount of hot wash water to the wash arms 11*a*, 11bis controlled in accordance with the rotational speed of motor 14*a*.

During the washing operation described above, the rotational speed of motor 14*a* is controlled at a relatively high speed defined by the first curve $L_1$. Accordingly, the pressure of wash water is controlled at a relatively high level to rapidly remove food soils from the racked dishes, while the racked dishes are stably retained in place by the gravity of themselves despite of the high pressure of wash water applied thereto. When the time of washing lapses from Ta to Tb, the output frequency f is increased in proportion to the lapse of time t to gradually increase the rotational speed of motor 14*a*. Thus, the supply amount of wash water and the pressure of jet streams are gradually increased until the output frequency f is increased to 60 Hz. This is useful to effect smooth rotation of the wash arms 11*a*, 11*b* without causing any impact on support mechanisms of the wash arms. In the lapse of time t from Tc to Td, the output frequency f is intermittently increased and decreased to cause variation of the rotational speed of motor 14*a*. Thus, the supply amount of wash water and the pressure of jet streams are intermittently increased and decreased to thoroughly scrub food soils from the racked dishes.

After the washing operation, the computer 40 produces an output signal with output frequency f defined by the second curve $L_2$ of the first control data in the lapse of time t from Te to Tf. When applied with the output signal from computer 40, the inverter 50 applies a three-phase alternating electric current power of 60 Hz to the electric motor 15*a* to control the rotational speed of motor 15*a*. Under such control of the electric motor 15a, the rinse pump 15 is driven to pump up the fresh hot rinse water from tank 16 and supply it to the rinse arms 12*a*, 12*b* through pipes $P_5$, $P_3$ and $P_4$, and in turn, the rinse arms 12*a*, 12*b* rotate to uniformly spray the hot rinse water over the racked dishes. In this embodiment, it is to be noted that the above control of the rotational speed of motors 14*a*, 15*a* can be effected by the inventer 50 without any influence caused by change of the power source frequency. The inverter 50 is also useful to eliminate connection of input wires necessary for reverse rotation of motors 14*a*, 15*a*.

2) When light tableware such as cups, glasses, saucers or the like has been placed in the rack 13 to be cleaned, the mode changeover switch 30 is closed after closing of the washing chamber door. In this instance, the computer 40 cooperates with the door switch 20 and mode changeover switch 30 to determine a "Yes" answer respectively at step 62 and 63. Thus, the program proceeds to step 66 where the computer 40 reads out the second control data from its read-only memory and causes the program to proceed to step 67 for a second control routine of the inverter 50. During execution of the second control routine, the computer 40 produces an output signal with output frequency f defined by the first curve $1_1$ of the second control data in accordance with the lapse of time t. When applied with the output signal from computer 40, the inverter 50 applies a three-phase alternating electric current power to the electric motor 14*a* to control the rotational speed of motor 14*a* in accordance with the output frequency f defined by the first curve $1_1$. Under such control of the electric motor 14a, the wash pump 14 is driven to pump up the hot wash water from tank 10*a* and supply it to the wash arms 11*a*, 11*b* through pipes $P_1$, $P_2$, and in turn, the wash arms 11*a*, 11*b* rotate to direct powerful jet streams of the wash water to the racked tableware. During such washing operation, the supply amount of hot wash water to the wash arms 11*a*, 11*b* is controlled in accordance with the rotational speed of motor 14*a*.

During the washing operation of the light tableware, the rotational speed of motor 14*a* is controlled at a relatively low speed related to the first curve $1_1$ of the second control data. Accordingly, the pressure of wash water is controlled at a relatively low level so that the racked tableware is stably retained in place despite of the pressure of wash water applied thereto. This is useful to protect the tableware from breakage caused by the pressure of wash water. When the time of washing lapses from ta to tb, the output frequency f is increased in proportion to the lapse of time t to gradually increase the rotational speed of motor 14*a*. Thus, the supply amount of wash water and the pressure of jet streams are gradually increased until the output frequency f is increased to 50 Hz. This is useful to effect smooth rotation of the wash arms 11*a*, 11*b* without causing any impact on support mechanisms of the wash arms. In the lapse of time t from tc to td, the output frequency f is intermittently increased and decreased to cause variation of the rotational speed of motor 14*a*. Thus, the supply amount of wash water and the pressure of jet streams are intermittently increased and decreased to thoroughly scrub food soils from the racked tableware.

After the washing operation, the computer 40 produces an output signal at output frequency f defined by the second curve 12 of the second control data in the lapse of time t from te to tf. When applied with the output signal from computer 40, the inverter 50 applies a three-phase alternating electric current power of 50 Hz to the electric motor 15*a*. Under such control of the electric motor 15*a*, the rinse pump 15 is driven to pump up the fresh hot rinse water from tank 16 and supply it to the rinse arms 12*a*, 12*b* through pipes $P_5$, $P_3$ and $P_4$, and in turn, the rinse arms 12*a*, 12*b* rotate to uniformly spray the hot rinse water over the racked tableware.

Having now fully set forth a preferred embodiment of the concept underlying the present invention, various other embodiments as well as certain modifications of the embodiment herein shown and described will obviously occur to those skilled in the art upon becoming familiar with said underlying concept. It is to be understood, therefore, that within the scope of the appended claims, the invention may be practiced otherwise than as specifically set forth herein.

What is claimed is:

1. An electric control apparatus for a dishwashing machine having a washing chamber, a wash pump arranged to be driven by an electric motor for pumping up wash water from a wash water storage tank in the washing chamber, and a revolving wash arm arranged within the washing chamber to be supplied with the wash water from the pump for directing jet streams of the wash water to a rack of tableware placed in the washing chamber, comprising:

memory mans for memorizing first and second control data, each of said first and second control data being defined in relation to the lapse of washing time such that the supply amount of wash water to said wash arm is gradually increased up to a predetermined amount at an initial stage of washing operation and is maintained at the predetermined amount during the washing operation;

means for controlling the rotational speed of said electric motor in accordance with the lapse of washing time based on one of said first and second control data; and selecting means for selecting between the first and second control data depending on the type of tableware to be washed in the washing chamber.

2. An electric control apparatus for a dishwashing machine having a washing chamber, a wash pump arranged to be driven by an electric motor for pumping up wash water from a wash water storage tank in the washing chamber, and a revolving wash arm arranged within the washing chamber to be supplied with the wash water from the pump for directing jet streams of the wash water to a rack of tableware placed in the washing chamber, comprising:

memory means for memorizing first and second control data, each of said first and second control data being defined in relation of the lapse of washing time such that the supply amount of wash water to said wash arm is intermittently increased and decreased after gradually increased up to a predetermined amount at an initial stage of washing operation;

means for controlling the rotational speed of said electric motor in accordance with the lapse of washing time based on one of said first and second control data; and selecting means for selecting between the first and second control data depending on the type of tableware to be washed.

3. An electric control apparatus for a dishwashing machine having a washing chamber, a wash pump arranged to be driven by an electric motor in the form of an induction motor for pumping up wash water from a wash water storage tank in the washing chamber, and a revolving wash arm arranged within the washing chamber to be supplied with the wash water from the pump for directing jet streams of the wash water to a rack of tableware placed in the washing chamber, comprising:

memory means for memorizing first and second control data in the form of frequency, each of said first and second control data being defined in relation to the lapse of washing time such that the supply amount of wash water to said wash arm is gradually increased up to a predetermined amount at an initial stage of washing operation and maintained at a predetermined amount during the washing operation;

inverter means for controlling the power supply to said induction motor in accordance with the lapse of washing time based on one of said first and second control data; and selecting means for selecting between the first and second control data depending on the type of tableware to be washed in the washing chamber.

4. An electric control apparatus for a dishwashing machine having a washing chamber, a wash pump arranged to be driven by an electric motor in the form of an induction motor for pumping up wash water from a wash water storage tank in the washing chamber, and a revolving wash arm arranged within the washing chamber to be supplied with the wash water from the pump for directing jet streams of the wash water to a rack of tableware placed in the washing chamber, comprising:

memory means for memorizing first and second control data in the form of frequency, each of said first and second control data being defined in relation to the lapse of washing time such that the supply amount of wash to said wash arm is intermittently increased and decreased after gradually increased up to a predetermined amount at an initial stage of washing operation;

inverter means for controlling the power supply to said induction motor in accordance with the lapse of washing time based on one of said first and second control data; and selecting means for selecting between the first and second control data depending on the type of tableware to be washed.

5. An electric control apparatus for a dishwashing machine having a washing chamber, a wash pump arranged to be driven by an electric motor for pumping up wash water from a wash water storage tank in the washing chamber, and a revolving wash arm arranged within the washing chamber to be supplied with the wash water from the pump for directing jet streams of the wash water to a rack of tableware placed in the washing chamber, comprising:

means for producing a first operation signal in a first condition where heavy tableware is placed in the rack in said washing chamber and for producing a second operation signal in a second condition where light tableware is placed in the rack in said washing chamber;

memory means for memorizing first control data defined in relation to the lapse of washing time such that the supply amount of wash water to said wash arm is controlled to be suitable for washing said heavy tableware in the first condition and for memorizing second control data defined in relation to the lapse of washing time such that the supply amount of wash water to said wash arm is controlled to be suitable for washing said light tableware in the second condition;

means for selecting said first control data in response to said first operation signal and for selecting said second control data in response to said second operation signal; and means for controlling the rotational speed of said electric motor in accordance with the lapse of washing time based on said selected control data.

6. An electric control apparatus for a dishwashing machine having a washing chamber, a wash pump arranged to be driven by an electric motor in the form of an induction motor for pumping up wash water from a wash water storage tank in the washing chamber, and a revolving wash arm arranged within the washing chamber to be supplied with the wash water from the pump for directing jet streams of the wash water to a rack of tableware placed in the washing chamber, comprising:

means for producing a first operation signal in a first condition where heavy tableware is placed in the rack in said washing chamber and for producing a second operation signal in a second condition where light tableware is placed in the rack in said washing chamber;

memory means for memorizing first frequency data defined in relation to the lapse of washing time such that the supply amount of wash water to said wash arm is controlled to be suitable for washing said heavy tableware in the first condition and for memorizing second frequency data defined in relation to the lapse of washing time to be lower than said first frequency data such that the supply amount of wash water to said wash arm is controlled to be suitable for washing said light tableware in the second condition;

means for selecting said first frequency data in response to said first operation signal and for selecting said second frequency data in response to said second operation signal; and inverter means for controlling the power supply to said induction motor in accordance with the lapse of washing time based on said selected frequency data.

* * * * *